US007530481B2

(12) United States Patent
Kim

(10) Patent No.: US 7,530,481 B2
(45) Date of Patent: May 12, 2009

(54) SHIRT PRESS MACHINE

(76) Inventor: Byung Hak Kim, 402-004 Hyundai 4-cha Apt., Bengohoon-dong 1-ge, Deokgn-gu, Jeonju, Jackabuk-do (KR)

( * ) Notice: Subject to any disclaimer, the term of this patent is extended or adjusted under 35 U.S.C. 154(b) by 64 days.

(21) Appl. No.: 11/734,917

(22) Filed: Apr. 13, 2007

(65) Prior Publication Data

US 2007/0246489 A1 Oct. 25, 2007

(30) Foreign Application Priority Data

Apr. 25, 2006 (KR) ..... 10-2006-0037184

(51) Int. Cl.
*D06F 71/20* (2006.01)
*D06F 59/02* (2006.01)

(52) U.S. Cl. ..... 223/70; 38/21

(58) Field of Classification Search ..... 223/52.1, 223/66–74; 38/20–24
See application file for complete search history.

(56) References Cited

U.S. PATENT DOCUMENTS 4,057,179 A * 11/1977 Everett ..... 223/73
6,758,377 B2 * 7/2004 Uchikoshi ..... 223/73
7,017,786 B2 * 3/2006 Ho ..... 223/73
7,314,151 B2 * 1/2008 Myoji ..... 223/70
7,370,778 B1 * 5/2008 Uchikoshi ..... 223/70

* cited by examiner

*Primary Examiner*—Ismael Izaguirre
(74) *Attorney, Agent, or Firm*—John K. Park; Park Law Firm

(57) ABSTRACT

The present invention relates to a shirt press machine which comprises a front left side press; a front right side press; and a rear press for pressing a rear part of the shirt, wherein the front left and right side presses approach the front left and right side parts of the shirt, respectively, so as to press them, and wherein the rear press approaches the rear part of the shirt so as to press it. The shirt press machine further comprises a pair of support arms for supportingly spreading out, the sleeves of the shirt, so that a high temperature and pressure hot air is applied to the sleeves of the shirt which are supportingly spread out obliquely downwardly to the left and right by the pair of support arms, thereby allowing the sleeves of the shirt to be ironed.

1 Claim, 5 Drawing Sheets

SHIRT PRESS MACHINE

BACKGROUND OF THE INVENTION

1. Field of the Invention

The present invention relates to a shirt press machine, and more particular, to a shirt press machine in which a pair of presses are separately mounted on the front left and right sides of the shirt press machine so as to allow a worker to easily and readily work while standing near the middle portion of the shirt press machine.

2. Background of the Related Art

In general, a conventional shirt press machine has a single press mounted at the center of the front side thereof. Thus, a worker needs to do much labor so as to press a shirt or apply a hot air to the shirt, that is, the worker has to move to the left when fixing and ironing the left sleeve of the shirt, and, move to the right when fixing and ironing the right sleeve. In other words, a pressing process of the conventional shirt press machine is performed such that left and right sleeves of the shirt are fixed on the press machine, are pulled to the left and right, respectively, so as to be spread out in their longitudinal directions, and then are applied with a hot air therein or ironed thereon. Thus, in order to conduct such pressing process, it is required that a worker should apply the hot air or press on the shirt by operating the machine after moving to a desired position to fix or hang one sleeve of the shirt on the machine and then additionally moving to another desired position to fix or hang the other sleeve thereon.

During such a pressing process, since the worker has to perform many actions while repeating his or her movement of left to right, the repetitive work is inevitably performed and the time required for the movement of left to right is consumed accordingly.

In such a conventional shirt press machine, fatigue accumulation of the worker is induced and much working time is spent. Therefore, there is a need for a solution which can reduce the fatigue accumulation of the worker as well as increase the amount of work capable of conducting within a unit time by shortening a movement line of the worker in order to manage a large-sized laundry business, for example, in a laundry factory.

SUMMARY OF THE INVENTION

Accordingly, the present invention has been made in an effort to solve the above problems occurring in the prior art, and it is an object of the present invention to provide a shirt press machine by which an operator can easily and readily press a body part, a left and right sleeves of a shirt after fixing them on the machine while standing near the middle portion of the machine without moving from a position to another position.

Another object of the invention is to provide a shirt press machine by which an operator can operate while standing near the middle portion of the machine, thereby reducing fatigue accumulation of the operator.

Still, another object of the invention is to provide a shirt press machine by which an operator can rapidly operate while standing near the middle portion of the machine by reducing the time required for her or his movement of left to right, thereby achieving a more effective operation in a large-sized laundry shop.

In order to accomplish the above objects, according to the present invention, there is provided a shirt press machine which comprises a front left side press for pressing a front left side part of a shirt which is hung on a human body model; a front right side press for pressing a front right side part of the shirt; and a rear press for pressing a rear part of the shirt, wherein the front left and right side presses approach the front left and right side parts of the shirt hung on the human body model, respectively, so as to press the front left and right side parts of the shirt, and wherein the rear press approaches the rear part of the shirt so as to press the rear part of the shirt.

In accordance with the present invention, when a shirt to be pressed is transported to an operator, the operator can hang the shirt on the machine while standing near the middle of the machine without her or his movement of left to right so as to hang the body part and left-right sleeves of the shirt on the machine, and then the shirt can be pressed by means of a simple operation means such as a button.

In accordance with the present invention, the body part and left-right sleeves of the shirt can be pressed by means of a high temperature and pressure hot air or pressed by applying a hot air therein.

In accordance with the present invention, the shirt comes into close contact with the machine by means of a vacuum suction force and is spread out so as to press the shirt after the body and left-right sleeves of the shirt are hung on the machine, and then a left and right portions of the machine supporting the left-right sleeves, are spread out to the left and right, respectively, so as to widen the left-right sleeves, thereby pressing the sleeves by applying a hot air therein.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Hereinafter, the transparent ornament of the present invention will be described in detail with reference to the appended drawings.

Figure 1:
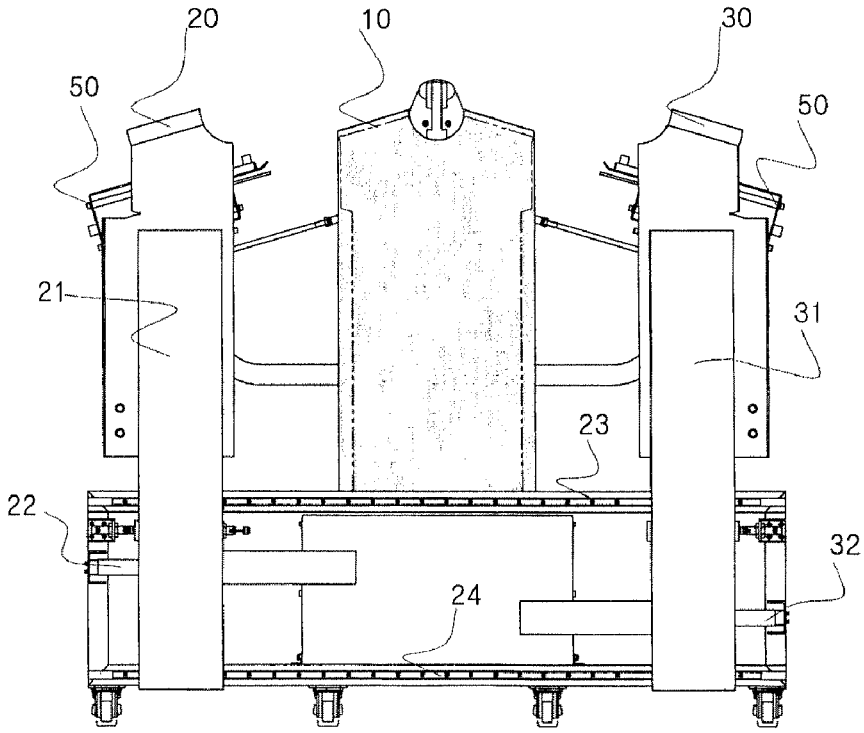
FIG. 1 is a front view of a shirt press machine according to an embodiment of the present invention.

FIG. 1 is a front view of a shirt press machine according to an embodiment of the present invention.

As shown in FIG. 1, the shirt press machine according to an embodiment of the present invention comprises: a front left side press 20 for pressing a front left side part of a shirt which is hung on a human body model 10; a front right side press 30 for pressing a front right side part of the shirt; and a rear press 40 for pressing a rear part of the shirt, wherein the front left and right side presses 20 and 30 approach the front left and right side parts of the shirt hung on the human body model, respectively, so as to press the front left and right side parts of the shirt, and wherein the rear press 40 approaches the rear part of the shirt so as to press the rear part of the shirt.

In accordance with the shirt press machine according to an embodiment of the present invention, the rear press 40 approaches the rear part of the shirt so as to iron it. The front left and right side presses 20 and 30 may have a pair of extension portions 21 and 31 extendable formed thereon in their longitudinal directions, respectively, so as to be connected to the guide rails 23 and 24.

In this regard, in order to allow the front left and right side presses 20 and 30 to be reciprocatingly moved along the guide rails 23 and 24, cylinders 22 and 32 using hydraulic or pneumatic pressure may be used. Here, the front left and right side presses approaching the shirt hung on the human body model need to be slidingly moved along the guide rails, and it is sufficient that they are separately mounted at the left and right at the front middle portion of the human body model.

In accordance with the shirt press machine according to an embodiment of the present invention, when the front left and right side presses 20 and 30 are slidingly moved toward the shirt hung on the human body model 10, the rear press 40 is preferably slidingly moved to the rear part of the shirt. Thereafter, the three different presses as described above simultaneously pressurizingly press the shirt hung on the human body model 10.

At this time, since the presses are heated to a high temperature, they momentarily heat the fiber of the shirt to press it.

First, the front left and right side presses 20 and 30 are slidingly moved to the shirt in their lateral directions, and then are moved toward the shirt by a predetermined distance by means of a reciprocating means such as an air cylinder. At this time, the shirt is preferably pressed on the pair of extension portions 21 and 31 of the front left and right side presses 20 and 30 by means of a means such as the air cylinder.

In accordance with the shirt press machine according to an embodiment of the present invention, as partially shown from the rear portion of the front left and right side presses of the FIG. 1, the shirt press machine further comprises a pair of support arms 50 for supportingly spreading out the sleeves of the shirt, so that a high temperature and pressure hot air is blown to the sleeves of the shirt which are supportingly spread out to the left and right by the pair of support arms 50, thereby allowing the sleeves to be ironed.

In accordance with the shirt press machine according to an embodiment of the present invention, the human body model 10 has a porous part formed on the front and rear portions thereof, respectively, and a hollow space defined therein. Further, the human body model 10 is connected at a side thereof to a blower, so that the shirt can be adsorbed on the human body model 10 by means of the operation of the blower after the shirts is hung thereon. At this time, the shirt hung on the human body model 10 is adsorbed on the human body model 10 so as not to be folded or wrinkled when being pressed, and then pressurized by the presses.

Figure 2:
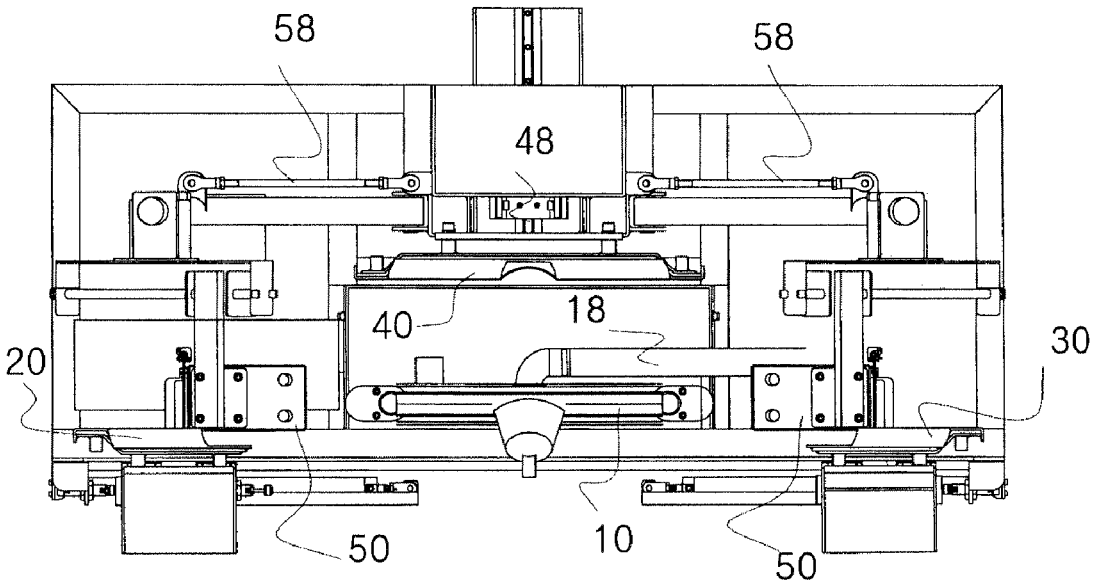
FIG. 2 is a top plan view of the shirt press machine according to an embodiment of the present invention.

FIG. 2 is a top plan view of the shirt press machine according to an embodiment of the present invention.

Referring to FIG. 2, a predetermined distance is formed between the human body model 10 and the respective the front left and right side presses 20 and 30, which may be a distance moved when the front left and right side presses 20 and 30 approach the shirt to press.

As shown in FIG. 2, the front left and right side presses 20 and 30, and the rear press 40 can press the shirt hung on the human body model 10 by means of a cylinder for pressurization, and the pair of support arms 50 for supportingly spreading out the sleeves is respectively mounted at the left and right sides of the human body model 10 in such a manner as to be opposed to each other and spaced apart from the human body model 10 by a predetermined distance.

The pair of support arms 50 are connected to a cylinder 58 and a rotation means 56. Thus, the sleeves supported by the pair of support arms are respectively spread out so as to be inclined downwardly by means of the operation of the cylinder 58 and the rotation means 56.

Figure 3:
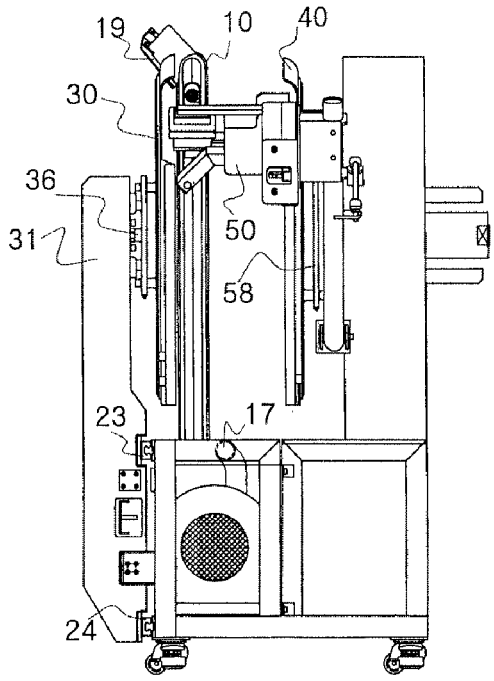
FIG. 3 is a side view of the shirt press machine according to an embodiment of the present invention.

FIG. 3 is a side view of the shirt press machine according to an embodiment of the present invention.

Referring to FIG. 3, the front right side press 30 has the extension portion extendable formed thereon in its longitudinal direction so as to be connected to the guide rails.

The shirt press machine of the invention features that after the front left and right side presses 20 and 30 are respectively moved to both lateral sides by means of the extension portions connected to the guide rails, the shirt is hung on the human body 10, and then automatically ironed by means of the simple button manipulation. In other words, the front left and right side presses 20 and 30 are moved to both lateral sides for the sake of convenience of the operator, and then the shirt is hung on the human body model 10 and the sleeves are hung on the pair of support arms 50, respectively, by the operator. Thereafter, the front left and right side presses 20 and 30 and the rear press 40 approach the shirt so as to pressurize the shirt, respectively, thereby ironing the body part of the shirt. At this time, the sleeves are spread out obliquely downwardly by means of the pair of support arms 50, and then are ironed by allowing the hot air of a high temperature and pressure to pass through the inside of the sleeves.

As shown in FIG. 3, the blower 83 is connected to the human body model 10, which has porous parts 12 and 14 formed on the front and rear surface thereof, respectively, and a hollow space defined therein, so as to allow the internal air of the human body model 10 to be sucked therethrough after the shirt is hung on the human body model 10, so that the shirt hung on the human body model 10 can be adsorbed and spread out thereon.

Figure 4:
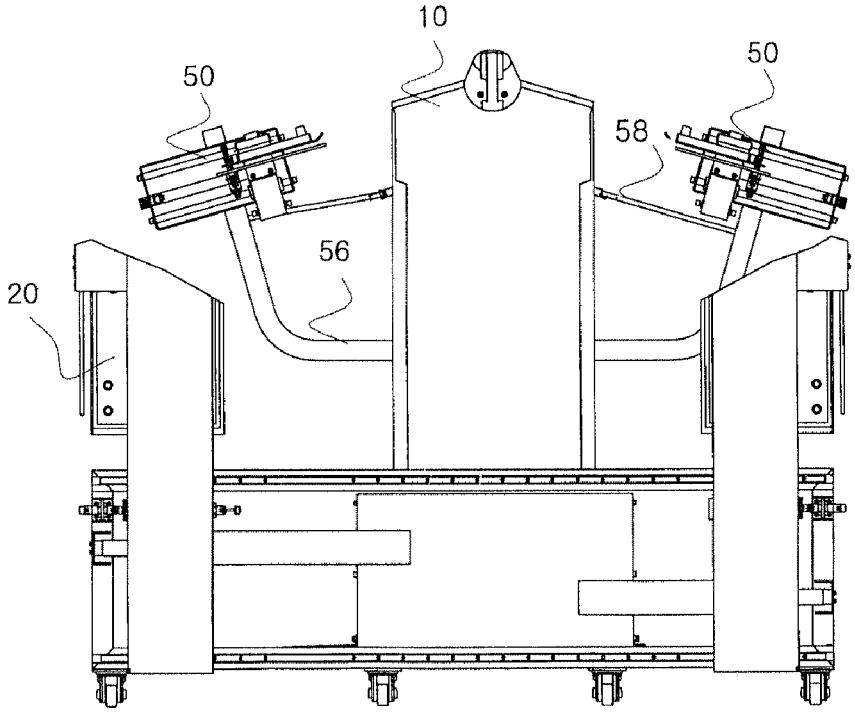
FIG. 4 is a front view showing a connection state of a pair of support arms of the shirt press machine according to an embodiment of the present invention.

FIG. 4 is a front view showing a connection state of a pair of support arms of the shirt press machine according to an embodiment of the present invention.

Referring to FIG. 4, the pair of support arms 50 are connected to the cylinder 58 and the rotation means 56 so as to allow the sleeves of the shirt to be spread out obliquely downward. Further, each of the support arms 50 is interconnected at the portion thereof supporting the sleeves to a passageway of the blower so as to allow the hot air of a high temperature and pressure to be injected to the sleeves through the passageway.

Figure 5:
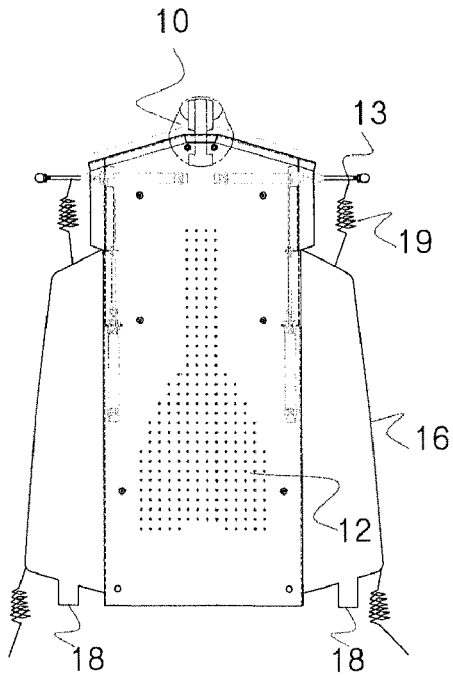
FIG. 5 is a front view of a human body model provided in the shirt press machine according to an embodiment of the present invention.

FIG. 5 is a front view of a human body model provided in the shirt press machine according to an embodiment of the present invention.

Referring to FIG. 5, there is shown a front surface of the human body model 10 having the porous part 12 formed thereon, and a pair of support members 13 on which the shoulder part of the sleeves is hung. The shirt is adsorbed and spread out on the human body model 10 while air is sucked through the porous parts formed on the front and rear surface of the human body model 10 by means of the blower, thereby being ironed to ensure that it is free from wrinkles. Further, the human body model 10 has a pair of air bags 16 mounted on the left and right side thereof, respectively. Thus, since the shirt covers around the human body model 10 together with the pair of air bags 16 at the time of being hung on the human body model 10, the pair of air bags 16 are swollen by the hot air to be injected thereto, so that the both sides of the body part of the shirt are ironed by means of the pair of air bags 16 swollen by the hot air. Each air bag has a connection section 18 formed at the lower portion thereof so as to allow a pair of hot air ports 84 to be connected thereto, and allow the hot air to be blown from the pair of hot air ports 84 to the air bag therethrough. Each of the pair of support members has a tension spring 19 mounted at a side thereof so as to be pulled to conform to the length of the sleeves of the shirt, thereby allowing the shirt to be ironed.

Figure 6:
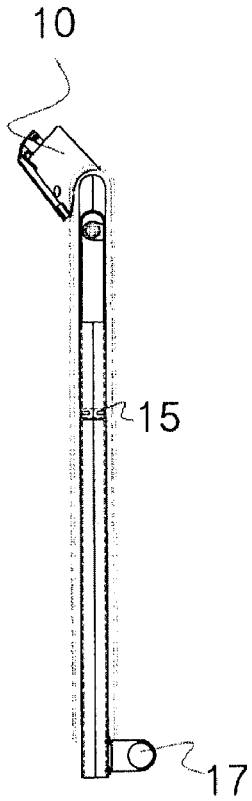
FIG. 6 is a side cross-sectional view of the human body model of the shirt press machine according to an embodiment of the present invention.

FIG. 6 is a side cross-sectional view of the human body model of the shirt press machine according to an embodiment of the present invention.

Referring to FIG. 6, the human body model 10 has a hollow space defined therein, and an extension passageway 17 formed at a side thereof in such a manner as to be extended to the blower. The human body model 10 further has a support member 15 which resists against the deformation of the human body model 10 when the interior air suction is induced by the blower formed thereon, so that the deformation of the front and rear surface of the human body model 10 can be prevented even at the time of the interior air suction.

Figure 7:
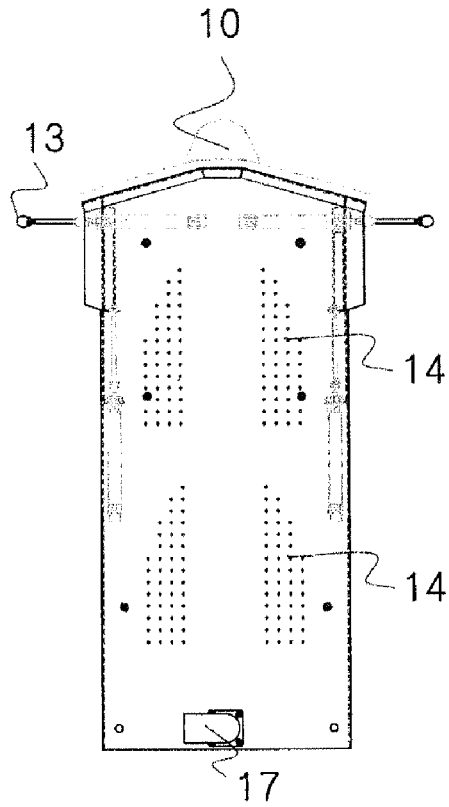
FIG. 7 is a rear view of the shirt press machine according to an embodiment of the present invention.

FIG. 7 is a rear view of the shirt press machine according to an embodiment of the present invention.

Referring to FIG. 7, the human body model 10 has a porous part 14 formed on the rear surface thereof, so that the rear part of the shirt is adsorbed and spread out on the human body model 10 therethrough when the interior air is sucked by the blower.

Figure 8:
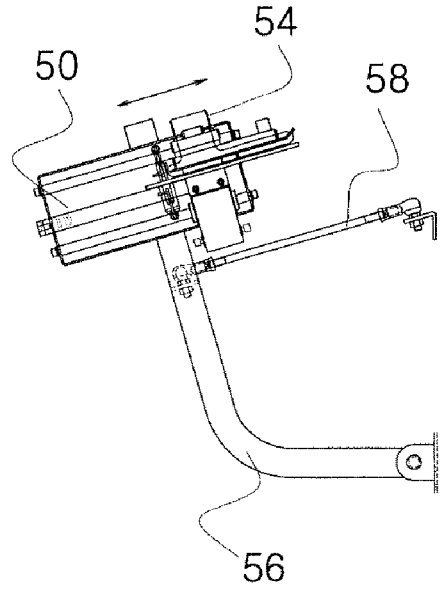
FIG. 8 is a side view showing an operation direction of the pair of support arms of the shirt press machine according to an embodiment of the present invention.

FIG. 8 is a side view showing an operation direction of the pair of support arms of the shirt press machine according to an embodiment of the present invention.

Referring to FIG. 8, the support arm has a sliding member 54 formed thereon so as to support the sleeve of the shirt. Once the shirt is hung on the human body model, the sleeve of the shirt is supported by the sliding member 54 formed on the support arm, and then is spread out obliquely downwardly to the left and right in the direction of the arrow of FIG. 8.

After the sleeves are spread out, the hot air of a high temperature and pressure which is supplied from the air heated in a heating element 82 is injected to the sleeve to iron it.

Figure 9:
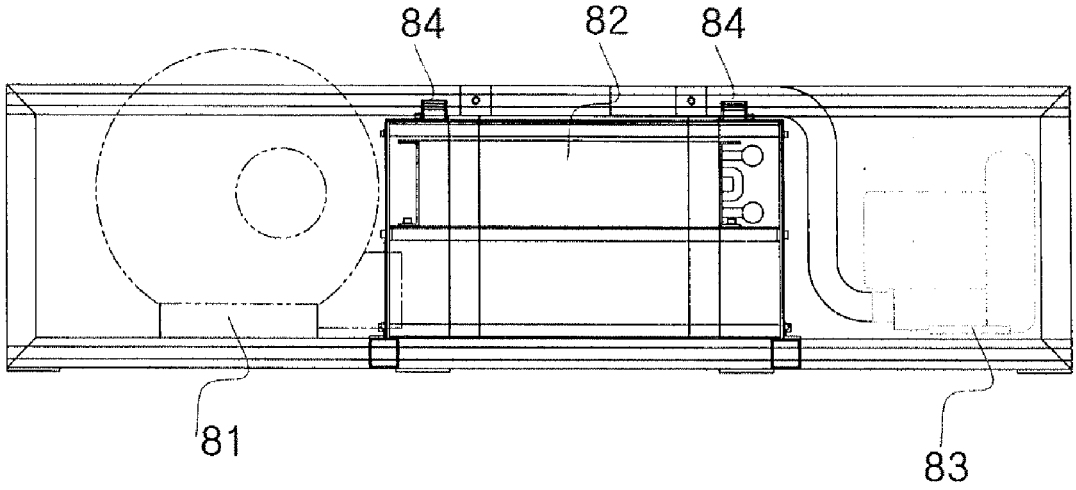
FIG. 9 is a side view showing a connection state between a first and a second blower of a hot air chamber of the shirt press machine according to an embodiment of the present invention.

FIG. 9 is a side view showing a connection state between a first and a second blower of a hot air chamber of the shirt press machine according to an embodiment of the present invention.

Referring to FIG. 9, the high-temperature air heated by the heating element 82 is supplied to the pair of air bags 16 through the pair of hot air ports 84. Thus, the pair of air bags 16 are swollen so as to iron the both sides of the shirt, and are more useful for ironing a shirt having a relatively big size.

As shown in FIG. 9, a hot air chamber mounted on the shirt press machine of the invention has a first blower 81 mounted at a side thereof for blowing the high temperature and pressure air, and a second blower 83 mounted at the other side thereof for exhausting the internal air of the human body model 10 to the outside so as to allow the shirt to be adsorbed on the human body model 10.

The shirt press machine as described above features that it comprises the front left side press 20 for pressing a front left side part of a shirt which is hung on a human body model 10; the front right side press 30 for pressing a front right side part of the shirt; and the rear press 40 for pressing a rear part of the shirt, wherein the front left and right side presses 20 and 30 approach the front left and right side parts of the shirt hung on the human body model, respectively, so as to press the front left and right side parts of the shirt, and wherein the rear press 40 approaches the rear part of the shirt so as to press the rear part of the shirt.

The shirt press machine further comprises the pair of support arms for supportingly spreading out the sleeves of the shirt, so that a high temperature and pressure hot air is applied to the sleeves of the shirt which are supportingly spread out obliquely downwardly to the left and right by the pair of support arms 50, thereby allowing the sleeves of the shirt to be ironed. Further, the human body model 10 has the porous parts formed on the front and rear portions thereof, respectively, the hollow space defined therein. The human body model 10 is connected at a side thereof to a blower, so that the shirt can be adsorbed on the human body model 10 by means of the operation of the blower after the shirt has been hung thereon.

According to the present invention, the process can be reduced, in which an operator should move to the left or right sides of the shirt press machine so as to iron the shirt, thereby achieving a rapid ironing operation, as well as reducing fatigue accumulation of the operator. Thus, the shirt press machine can reduce the burden of the heavy work of the operator undertaken in a work place, where a large quantity of laundries are treated, such as a laundry factory.

Therefore, the body of the shirt is hung on the human body model and the sleeves of the shirt are supported by the pair of support arms, and then automatically ironed by means of the simple button manipulation. In other words, since the shirt is hung on the human body model and the sleeves of the shirt are supported by the pair of support arms in a state where the front left and right side presses are moved to the both lateral sides, the operator can considerably reduce a working movement line while pressing the shirt. Thus, the fatigue accumulation of the operator can be relatively reduced as compared to the conventional shirt press machine having only one front press.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A shirt press machine comprising;

a front left side press for pressing a front left side part of a shirt which is hung on a human body model;

a front right side press for pressing a front right side part of the shirt; and a rear press for pressing a rear part of the shirt, wherein the front left and right side presses approach the front left and right side parts of the shirt hung on the human body model, respectively, so as to press the front left and right side parts of the shirt, and wherein the rear press approaches the rear part of the shirt so as to press the rear part of the shirt, further comprising a pair of support arms for supportingly spreading out the sleeves of the shirt, so that a high temperature and pressure hot air is applied to the sleeves of the shirt which are supportingly spread out obliquely downwardly to the left and right by the pair of support arms, thereby allowing the sleeves of the shirt to be ironed, wherein the human body model has a porous part formed on the front and rear portions thereof, respectively, a hollow space defined therein, and a pair of air bags mounted on the left and right side thereof, respectively, so as to allow the shirt to be swollen by the air bags in conformance with the size of the shirt, the human body model being connected at a side thereof to a blower so as to allow the shirt to be adsorbed on the human body model by means of the operation of the blower after the shirt has been hung on the human body model, wherein the front left and right side presses move along reciprocatingly move a long guide rails so as to approach the shirt hung on the human body model.

* * * * *